US008118645B2

(12) United States Patent
Wang

(10) Patent No.: US 8,118,645 B2
(45) Date of Patent: Feb. 21, 2012

(54) POLISHING METHOD, POLISHING PAD, AND POLISHING SYSTEM

(75) Inventor: Yu-Piao Wang, Hsinchu County (TW)

(73) Assignee: IV Technologies Co., Ltd., Taichung (TW)

( * ) Notice: Subject to any disclaimer, the term of this patent is extended or adjusted under 35 U.S.C. 154(b) by 522 days.

(21) Appl. No.: 12/351,418

(22) Filed: Jan. 9, 2009

(65) Prior Publication Data

US 2009/0191794 A1 Jul. 30, 2009

(30) Foreign Application Priority Data

Jan. 30, 2008 (TW) ..... 97103481 A

(51) Int. Cl.
*B24B 1/00* (2006.01)

(52) U.S. Cl. ..... 451/41; 451/272; 451/273; 451/274; 451/527

(58) Field of Classification Search ..... 451/41, 451/527, 306, 272, 274, 287–289
See application file for complete search history.

(56) References Cited

U.S. PATENT DOCUMENTS 5,489,233 A * 2/1996 Cook et al. ..... 451/41
5,868,605 A * 2/1999 Cesna ..... 451/41
5,984,769 A * 11/1999 Bennett et al. ..... 451/527
6,066,230 A * 5/2000 Arai ..... 156/345.13
6,261,168 B1 * 7/2001 Jensen et al. ..... 451/527
6,273,806 B1 * 8/2001 Bennett et al. ..... 451/527
6,315,857 B1 * 11/2001 Cheng et al. ..... 156/345.12
6,458,014 B1 * 10/2002 Ihsikawa et al. ..... 451/6
6,783,436 B1 * 8/2004 Muldowney ..... 451/41
6,824,455 B2 * 11/2004 Osterheld et al. ..... 451/285
6,837,779 B2 * 1/2005 Smith et al. ..... 451/307
7,121,938 B2 * 10/2006 Suzuki ..... 451/527
7,927,187 B2 * 4/2011 Watanabe et al. ..... 451/41
2004/0058630 A1 * 3/2004 Park et al. ..... 451/288
2004/0097174 A1 * 5/2004 Shirakashi et al. ..... 451/41
2004/0259479 A1 * 12/2004 Sevilla ..... 451/41
2006/0270325 A1 * 11/2006 Choi ..... 451/285

* cited by examiner

*Primary Examiner* — George Nguyen
(74) *Attorney, Agent, or Firm* — Ditthavong Mori & Steiner, P.C.

(57) ABSTRACT

A polishing method, a polishing pad, and a polishing system are described. The polishing pad with a plurality of grooves is provided. The width of each groove is W and the pitch between two adjacent grooves is P. An oscillatory movement distance of a workpiece on the polishing pad is set. The oscillatory movement distance enables any particular point on the workpiece to cross the same number of grooves, when a direction between the particular point and the center of the workpiece is perpendicular to a tangential direction of the grooves. The workpiece is then polished with the oscillatory movement distance, so as to achieve a better polishing uniformity for the surface of the workpiece.

33 Claims, 6 Drawing Sheets

POLISHING METHOD, POLISHING PAD, AND POLISHING SYSTEM

CROSS-REFERENCE TO RELATED APPLICATION

This application claims the priority benefit of Taiwan application serial no. 97103481, filed on Jan. 30, 2008. The entirety of the above-mentioned patent application is hereby incorporated by reference herein and made a part of specification.

BACKGROUND OF THE INVENTION

1. Field of the Invention

The present invention generally relates to a polishing pad, a polishing system, and a polishing method, in particular, to a polishing pad, a polishing system, and a polishing method capable of achieving a better polishing uniformity for the surface of a workpiece.

2. Description of Related Art

With progress of industrial technology, planarization processes are usually adopted for producing various devices, and a polishing process is one of the planarization processes often employed in the industry. Generally, in the polishing process, a fixed workpiece is pressed on a polishing pad by a pressure applied to the workpiece, and capable of moving relative to the surface of the polishing pad. As such, the surface of the workpiece is partially removed through friction generated by the above relative movement, and thus gradually becomes planarized.

FIG. 1 is a schematic top view of a conventional circular polishing pad. The circular polishing pad 110 includes a plurality of concentric circular grooves 120. The concentric circular grooves 120 are used to accommodate or remove residues or by-products generated by polishing, and enable a workpiece 130 to be easily detached away from the circular polishing pad 110 when the polishing process is completed.

During the polishing process, the circular polishing pad 110 rotates, and the workpiece 130 in contact with the surface of the circular polishing pad 110 rotates as well, expecting that every portion on the surface of the workpiece 130 may contact the concentric circular grooves 120. However, each of the concentric circular grooves 120 on the conventional circular polishing pad 110 has a circular shape, and the workpiece 130 rotates around its central axis. Thus, when a particular point moves periodically to a position where a direction between the particular point and the center of the workpiece 130 is perpendicular to a tangential direction of the grooves, the particular point will be constantly at a groove position or a non-groove position. For example, if the particular point is at the groove position, points adjacent to the particular point would be constantly at the non-groove positions, thus affecting the polishing uniformity. Moreover, the above problem gets worse at positions closer to the central portion of the workpiece 130, as the central portion of the workpiece 130 is almost constantly in contact with a specific position (for example, the groove position or the non-groove position) on the circular polishing pad 110 during the whole polishing process. Therefore, the polishing rate of the central portion of the workpiece 130 is lower or higher than the polishing rates of the other near portions, depending on whether the central portion is constantly in contact with the groove position or the non-groove position. The problem of non-uniform polishing rate of the workpiece 130 may eventually degrade the reliability of the device.

Therefore, a polishing pad and a polishing method are required to provide a better polishing uniformity.

SUMMARY OF THE INVENTION

Accordingly, the present invention is directed to a polishing method to achieve a workpiece with a flat surface.

The present invention is further directed to a polishing pad capable of achieving a uniform polishing rate for the surface of a workpiece.

The present invention is also directed to a polishing system capable of achieving a better polishing uniformity for every portion on the surface of a workpiece.

A polishing method including the following steps is provided. First, a polishing pad having a plurality of grooves is provided. A width of each groove is W, and a pitch between two adjacent grooves is P. Then, an oscillatory movement distance of a workpiece on the polishing pad is set. The oscillatory movement distance enables any particular point on the workpiece to cross the same number of grooves, when a direction between the particular point and the center of the workpiece is perpendicular to a tangential direction of the grooves. Afterward, a polishing process is performed on the workpiece with the oscillatory movement distance.

Another polishing method including the following steps is provided. First, a polishing pad having a plurality of grooves is provided. A width of each groove is W, and a pitch between two adjacent grooves is P. Then, an oscillatory movement distance of a workpiece on the polishing pad is set as $D \cong P \times N - W$, and N is a positive integer. Afterward, a polishing process is performed on the workpiece with the oscillatory movement distance.

A polishing pad for performing a polishing process on a workpiece is further provided. During the polishing process, the workpiece is set with an oscillatory movement distance D on the polishing pad. The polishing pad includes a plurality of grooves, a width W of each groove and a pitch P between two adjacent grooves satisfy $D \cong P \times N - W$, and N is a positive integer.

A polishing system including a polishing pad and a workpiece is also provided. The polishing pad has a plurality of grooves, a width of each groove is W, and a pitch between two adjacent grooves is P. The workpiece is disposed on the polishing pad, and the workpiece is set with an oscillatory movement distance D on the polishing pad. The oscillatory movement distance is $D \cong P \times N - W$, and N is a positive integer.

According to the polishing method, the polishing pad, and the polishing system provided by the present invention, relative relations between the oscillatory movement distance of the workpiece on the polishing pad, the width of each groove, and the pitch between two grooves can be adjusted to achieve a better polishing uniformity for the surface of the polished workpiece.

In order to make the aforementioned and other objectives, features, and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a portion of this specification. The drawings illustrate embodiments of the invention and, together with the description, serve to explain the principles of the invention.

DESCRIPTION OF THE EMBODIMENTS

Figure 1:
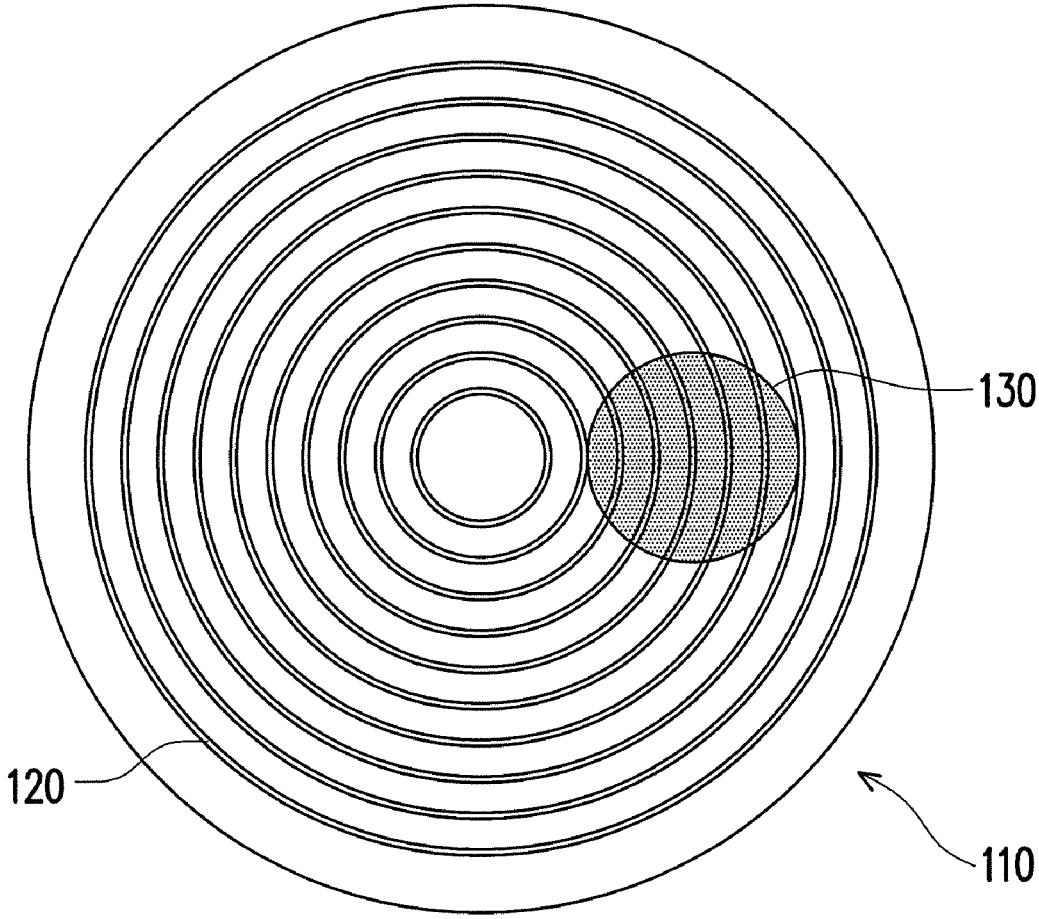
FIG. 1 (PRIOR ART)
FIG. 1 is a schematic top view of a conventional circular polishing pad.

Reference will now be made in detail to the present embodiments of the invention, examples of which are illustrated in the accompanying drawings. Wherever possible, the same reference numbers are used in the drawings and the description to refer to the same or like parts.

Figure 2:
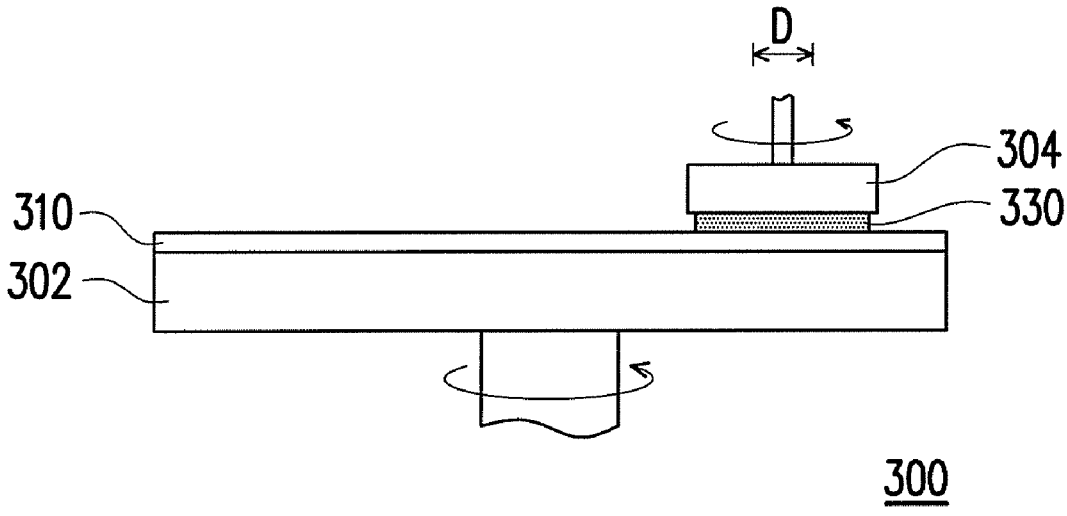
FIG. 2 is a schematic cross-sectional view of a polishing system according to an embodiment of the present invention.
Figure 3:
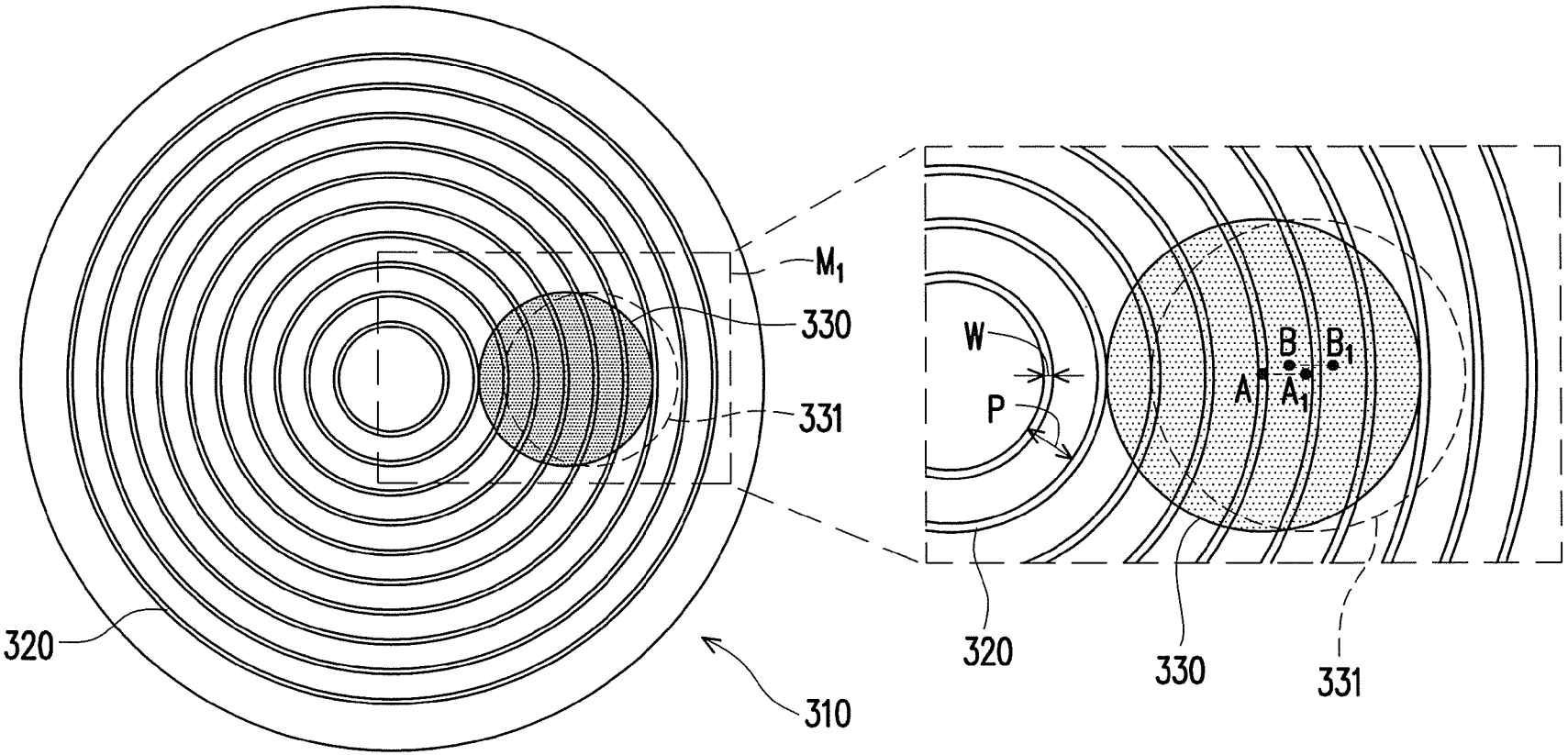
FIG. 3 is a schematic top view of a polishing pad according to an embodiment of the present invention.

FIG. 2 is a schematic cross-sectional view of a polishing system according to an embodiment of the present invention, and FIG. 3 is a schematic top view of a polishing pad according to an embodiment of the present invention. It should be noted that, in order to simplify the drawing, the rotation of a workpiece and the structure of a workpiece carrier are omitted in FIG. 3, but it is not intended to limit the scope of the present invention. Referring to FIG. 2, a polishing system 300 includes a polishing platen 302, a workpiece carrier 304, a polishing pad 310, and a workpiece 330. The polishing platen 302 is, for example, used to sustain the polishing pad 310. The workpiece carrier 304 is, for example, used to fix the workpiece 330 on a surface of the polishing pad 310. Further, in an embodiment, the polishing system 300 is selectively provided with a polishing slurry or solution during the polishing process, such that the polishing system 300 becomes a chemical mechanical polishing (CMP) process. The polishing pad, the polishing system, and the polishing method of the present invention are applicable to the polishing process during the fabrication of devices, such as semiconductors, integrated circuits, micro-electromechanical systems, energy transforming devices, communication devices, optical devices, storage disks, displays, and other devices need to be fabricated using the polishing process. The workpieces 330 used to fabricate the above devices include, but not limited to, semiconductor wafers, III-V group wafers, storage device carriers, ceramic substrates, polymer substrates, and glass substrates.

The polishing pad 310 is, for example, adhered to a surface of the polishing platen 302 for polishing the workpiece 330. The polishing pad 310 is, for example, formed by a polymer base material, and the polymer base material may be synthesized by a thermosetting resin or a thermoplastic resin. In addition to the polymer base material, the polishing pad 310 may further include conductive materials, abrasive particles, micro-spheres, or soluble additives embedded in the polymer base material.

Referring to FIGS. 2 and 3, the polishing pad 310 has a plurality of grooves 320. In this embodiment, the polishing platen 302 is a circular rotary disc, the polishing pad 310 is a circular polishing pad, and the grooves 320 are, for example, concentric circular grooves. A width of each groove 320 is W, and a pitch between two adjacent grooves 320 is P. When the polishing platen 302 rotates, the polishing pad 310 adhered to the surface of the polishing platen 302 is driven to rotate.

The workpiece carrier 304 is disposed on the polishing platen 302, for fixing the workpiece 330 and pressing the workpiece 330 on the surface of the polishing pad 310, such that the surface of the workpiece 330 to be polished may contact the polishing pad 310. In addition to enabling the workpiece 330 to rotate on the polishing pad 310, the workpiece carrier 304 can also drive an oscillatory movement and make the workpiece 330 shift back and forth on the polishing pad 310, such that the contact between the workpiece 330 and the polishing pad 310 may not be confined within a certain region. Thereby, the polishing rate and uniformity become more stable, and the polishing process will be more even.

It should be particularly illustrated that, the workpiece 330 has an oscillatory movement distance D due to the back and forth movement on the polishing pad 310, and the oscillatory movement distance D satisfies an equation as below:

$D \cong P \times N - W$, and $N$ is a positive integer.

In detail, an oscillatory movement is driven by the workpiece carrier 304 to shift the workpiece 330 back and forth on the polishing pad 310, and a direction of the oscillatory movement is perpendicular to a tangential direction of the grooves 320. Taking the concentric circular grooves for example, the direction of the oscillatory movement is a radial direction of the concentric circular grooves. In addition, the oscillatory movement distance D of the workpiece 330 is approximately equal to a difference obtained by subtracting the width W of the groove 320 from integer multiples of the pitch P between two adjacent grooves 320 on the polishing pad 310.

For example, when a direction between a particular point and the center of the workpiece 330 is perpendicular to a tangential direction of the grooves, as shown in a partial enlarged view of a region $M_1$ in FIG. 3, before the workpiece 330 moving oscillatingly, a particular point A on the workpiece 330 contacts a groove position of the polishing pad 310, and another particular point B on the workpiece 330 contacts a non-groove position of the polishing pad 310. When N=1, i.e., the oscillatory movement distance D of the workpiece 330 on the polishing pad 310 is set as $D \cong P - W$, the workpiece 330, for example, shifts to a position 331, the particular point A on the workpiece 330 moves to a position $A_1$ with the oscillatory movement of the workpiece 330, and meanwhile the particular point B moves to a position $B_1$ with the oscillatory movement of the workpiece 330. In the circumstance, the particular point A on the workpiece 330 originally located at a groove position may move to the non-groove position $A_1$, and the particular point B on the workpiece 330 originally located at a non-groove position may move across a groove to the adjacent non-groove position $B_1$. Therefore, when moving to the position 331 with the oscillatory movement of the workpiece 330, the particular points A and B on the workpiece 330 respectively contact the grooves 320 on the polishing pad 310 once. As such, the particular portions on the workpiece 330 may alternately cross the groove and non-groove positions instead of being fixed at the groove or non-groove positions.

Figure 4:
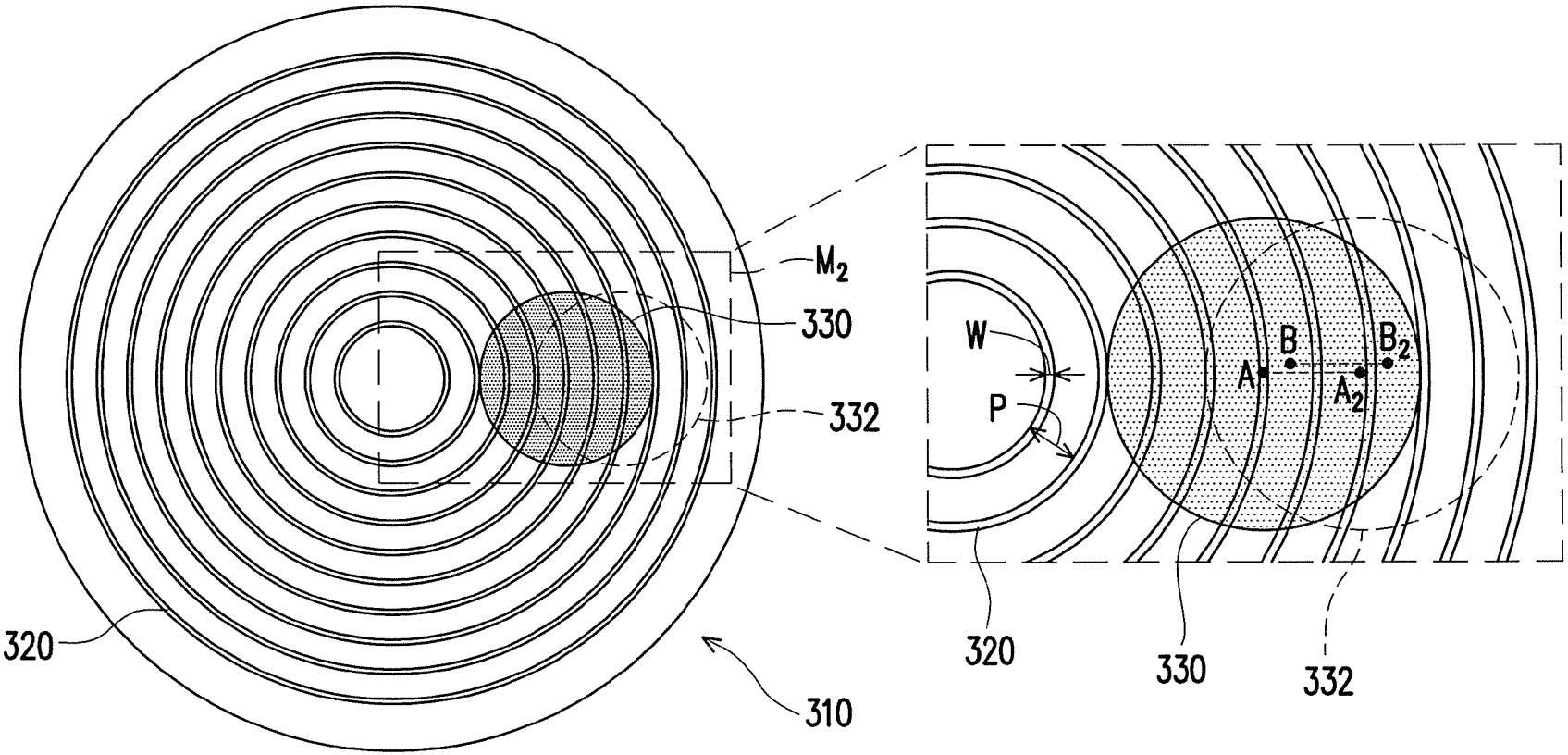
FIG. 4 is a schematic top view of a polishing pad according to another embodiment of the present invention.

FIG. 4 is a schematic top view of a polishing pad according to another embodiment of the present invention. In FIG. 4, the same means as those in FIG. 3 are represented by the same symbols, and the illustrations thereof are omitted. In another embodiment, for example, when N=2, the oscillatory movement distance D of the workpiece 330 on the polishing pad 310 is set as $D \cong 2P - W$. When a direction between a particular point and the center of the workpiece 330 is perpendicular to a tangential direction of the grooves, as shown in a partial enlarged view of a region $M_2$ in FIG. 4, and the workpiece 330 shifts to a position 332, a particular point A on the workpiece 330 originally located at a groove position may move across another groove to a non-groove position $A_2$, and a particular point B on the workpiece 330 originally located at a non-groove position may move across two grooves to an adjacent non-groove position $B_2$. Moreover, when moving to the position $A_2$ with the oscillatory movement of the workpiece 330, the particular point A on the workpiece 330 may contact the grooves 320 on the polishing pad 310 twice. When moving to the position $B_2$ with the oscillatory movement of the workpiece 330, the particular point B on the workpiece 330 may contact the grooves 320 on the polishing pad 310 twice as well. Therefore, the particular points on the workpiece 330 may uniformly and alternately cross the groove and non-groove positions instead of being fixed at the groove or non-groove positions.

Similarly, when N=3, 4, . . . , or any other positive integer, the particular point A on the workpiece 330 originally located at a groove position may move across another N−1 grooves to a non-groove position $A_N$ (not shown) with the oscillatory movement of the workpiece 330, and the particular point B on the workpiece 330 originally located at a non-groove position may move across N grooves to a non-groove position $B_N$ (not shown) with the oscillatory movement of the workpiece 330. In addition, when shifting to the positions $A_N$ and $B_N$, the particular points A and B on the workpiece 330 respectively cross the same number of the grooves 320 on the polishing pad 310, i.e., N grooves. As such, every particular point on the workpiece 330 may uniformly cross the groove and non-groove positions instead of being fixed at the groove or non-groove positions.

In this manner, during the whole polishing process, by adjusting the oscillatory movement distance D of the workpiece 330 on the polishing pad 310, a particular point may not be fixed at a groove or non-groove position, when a direction between the particular point and the center of the workpiece 330 is perpendicular to a tangential direction of the grooves. Particularly, the central portion of the workpiece 330 may not constantly contact the specific position (for example, the groove position or the non-groove position) on the polishing pad 310 during the whole polishing process. Therefore, the polishing rate of the central portion of the workpiece 330 would be closer to the polishing rates of the other near portions of the workpiece 330, thus achieving a better polishing uniformity for the surface of the workpiece 330.

Figure 5:
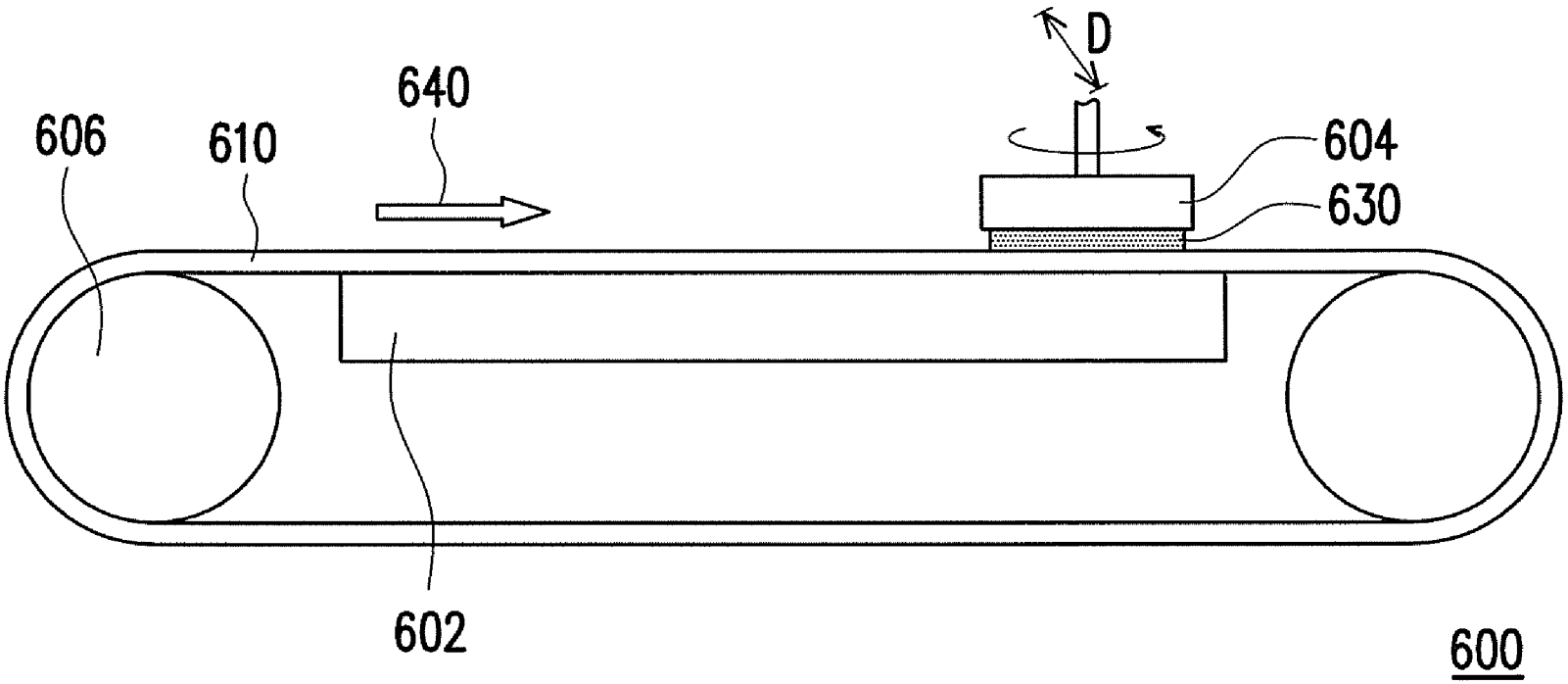
FIG. 5 is a schematic cross-sectional view of a polishing system according to another embodiment of the present invention.
Figure 6:
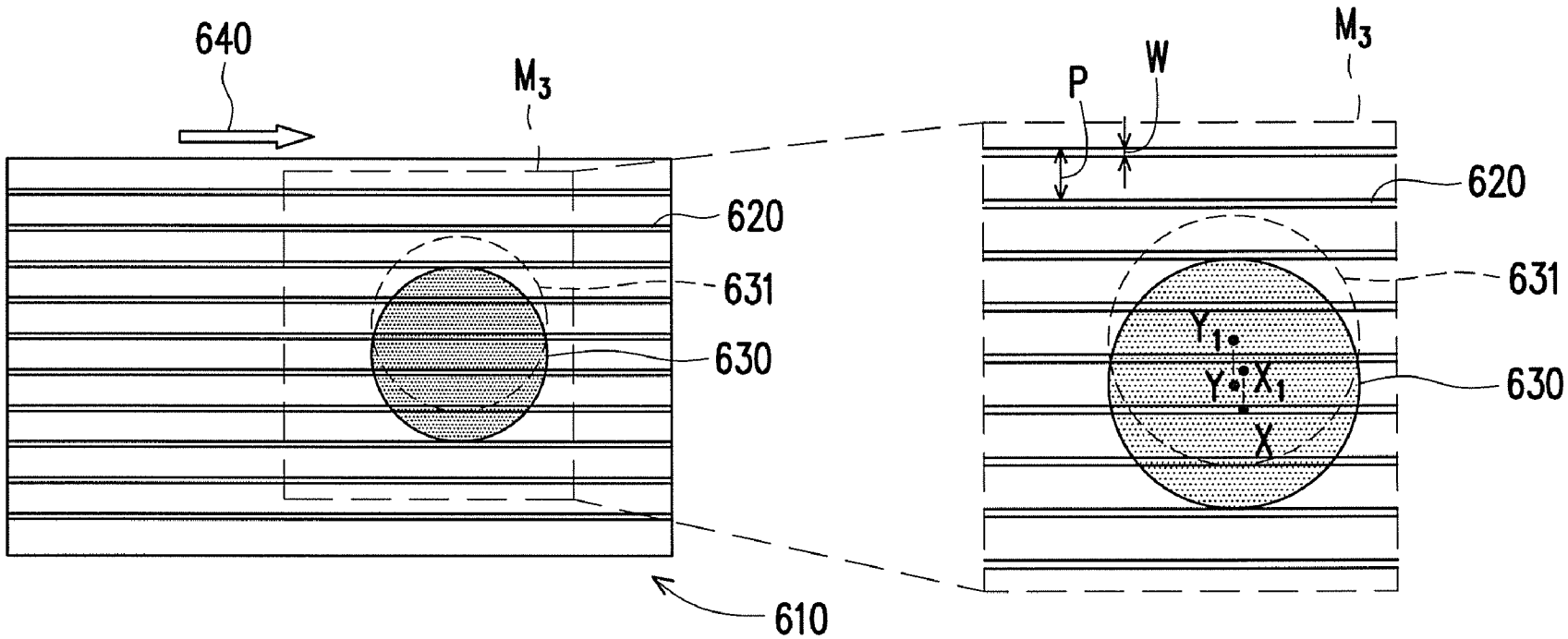
FIG. 6 is a schematic top view of a polishing pad according to another embodiment of the present invention.

The above embodiment takes a circular polishing platen, a circular polishing pad, and concentric circular grooves as an example, but the present invention is not limited thereto. In addition to the above embodiment, the present invention also has other implementation aspects. FIG. 5 is a schematic cross-sectional view of a polishing system according to another embodiment of the present invention, and FIG. 6 is a schematic top view of a polishing pad according to another embodiment of the present invention. In FIGS. 5 and 6, illustrations of means similar to those in FIG. 2 are omitted. Further, in order to simplify the drawing, the rotation of a workpiece and the structure of a workpiece carrier are omitted in FIG. 6, but it is not intended to limit the scope of the present invention. Referring to FIGS. 5 and 6 together, in this embodiment, a polishing system 600 includes a polishing platen 602, a workpiece carrier 604, driving wheels 606, a polishing pad 610, and a workpiece 630. In addition, in an embodiment, the polishing system 600 is selectively provided with a polishing slurry or solution during the polishing process, such that the polishing system 600 becomes a CMP process.

The polishing platen 602 is, for example, a fixed platen. The polishing pad 610, for example, a strip polishing pad, is movably sustained on a surface of the polishing platen 602. The polishing pad 610 is driven by the driving wheels 606 disposed on two sides of the polishing pad 610 to move like a conveyer belt linearly, i.e., in a moving direction 640 as shown in FIGS. 5 and 6. Moreover, the polishing pad 610 has a plurality of grooves 620. In an embodiment, the groove 620 is a linear groove, and a longitudinal direction of each groove 620 is, for example, parallel to the moving direction 640 of the polishing pad 610. The grooves 620 are, for example, arranged parallel to each other, a width of each groove 620 is W, and a pitch between two adjacent grooves 620 is P.

The workpiece carrier 604 for fixing the workpiece 630 on a surface of the polishing pad 610 is disposed on the polishing platen 602. In addition to enabling the workpiece 630 to rotate on the polishing pad 610, the workpiece carrier 604 can also drive an oscillatory movement to make the workpiece 630 shift back and forth on the polishing pad 610, so as to improve the polishing uniformity. The direction of the back and forth oscillatory movement of the workpiece 630 on the polishing pad 610 is, for example, perpendicular to a tangential direction of the grooves 620, i.e., perpendicular to the longitudinal direction of the linear grooves 620 in this embodiment. Further, the workpiece 330 has an oscillatory movement distance D satisfying an equation below on the polishing pad 610:

$$D \cong P \times N - W, \text{ and } N \text{ is a positive integer.}$$

In detail, for example, when N=1, referring to FIG. 6, during the polishing process, the workpiece 630 shifts back and forth on the polishing pad 610 with an oscillatory movement distance D≅P−W to a position 631. When a direction between a particular point and the center of the workpiece 630 is perpendicular to a tangential direction of the grooves 620, as shown in a partial enlarged view of a region $M_3$ in FIG. 6, a particular point X on the workpiece 630 originally located at a groove position may move to a non-groove position $X_1$ with the oscillatory movement of the workpiece 630, and meanwhile a particular point Y on the workpiece 630 originally located at a non-groove position may move across a groove to an adjacent non-groove position $Y_1$ with the oscillatory movement of the workpiece 630. Therefore, when moving to the position 631 with the oscillatory movement of the workpiece 630, the particular points X and Y on the workpiece 330 respectively contact the grooves 620 on the polishing pad 610 once. Therefore, the particular points on the workpiece 630 may alternately cross the groove and non-groove positions instead of being fixed at the groove or non-groove positions.

Similarly, when N=2, 3, . . . , and any other random positive integer, the particular point X on the workpiece 630 originally located at a groove position may move across another N−1 grooves to a non-groove position $X_N$ (not shown) with the oscillatory movement of the workpiece 630, and the particular point Y on the workpiece 630 originally located at a non-groove position may move across N grooves to a non-groove position $Y_N$ (not shown) with the oscillatory movement of the workpiece 630. In addition, when oscillating and shifting to the positions $X_N$ and $Y_N$, the particular points X and Y on the workpiece 630 respectively cross the same number of the grooves 620 on the polishing pad 610, i.e., N grooves. As such, every particular point on the workpiece 630 may uniformly cross the groove and non-groove positions instead of being fixed at the groove or non-groove positions.

Moreover, in the above embodiment, if the direction of the back and forth oscillatory movement of the workpiece 630 on the polishing pad 610 is not perpendicular to a tangential direction of the grooves 620, for example, having an angle of θ to the longitudinal direction of the linear grooves 620, the workpiece 630 has an oscillatory movement distance D satisfying an equation below on the polishing pad 610:

$$D \times \sin\theta \cong P \times N - W, \text{ and } N \text{ is a positive integer.}$$

In this manner, in the polishing system 600, by adjusting the oscillatory movement distance D of the workpiece 630 on the polishing pad 610, the particular points of the workpiece 630 can alternately cross the groove and non-groove positions, so as to achieve a better polishing uniformity for the surface of the workpiece 630.

Further, the polishing method provided by the present invention is suitable for polishing the surface of a workpiece. First, a polishing pad having a plurality of grooves is provided. A width of each groove is W, and a pitch between two adjacent grooves is P. The polishing pad is, for example, a circular polishing pad or a strip polishing pad. When the circular polishing pad is adopted, the grooves on the polishing pad are concentric circular grooves, and when the strip polishing pad is adopted, the grooves on the polishing pad are linear grooves. It should be noted that, the polishing pad used in the polishing method of the present invention may also be any type of polishing pad employed in the polishing system of the above embodiments, and the present invention is not limited thereto. Afterward, an oscillatory movement distance of the workpiece on the polishing pad is set. The oscillatory movement distance enables any particular point on the workpiece to cross the same number of grooves, when a direction between the particular point and the center is perpendicular to a tangential direction of the grooves. In an embodiment, the oscillatory movement distance $D \cong P \times N - W$, and N is a positive integer. Then, a polishing process is performed on the workpiece with the oscillatory movement distance. The particular points on the workpiece may not be fixed at the groove or non-groove positions by adjusting the oscillatory movement distance. Particularly, the central portion of the workpiece may not constantly contact the specific position (for example, the groove position or the non-groove position) on the polishing pad during the whole polishing process. Therefore, the polishing method of the present invention may achieve a better polishing uniformity.

It should be further illustrated that, in addition to adjusting the oscillatory movement distance D of the workpiece on the polishing pad through the configuration of the grooves on the polishing pad, the present invention may also be applied to a polishing system with a fixed oscillatory movement distance D of the workpiece on the polishing pad. In an embodiment, when the oscillatory movement distance D is fixedly set as 25.4 mm, a suitable polishing pad may be fabricated according to the fixed oscillatory movement distance D of the workpiece on the polishing pad. That is, the fabricated polishing pad has a groove width W and a pitch P between two adjacent grooves satisfying an equation of $D \cong P \times N - W$, where N is a positive integer. Taking a fixed groove width W=0.6 mm as an example, when N=4, the pitch P between two adjacent grooves is approximately 6.5 mm, and when N=5, the pitch P between two adjacent grooves is approximately 5.2 mm.

In view of the above, according to the polishing method, the polishing pad, and the polishing system of the present invention, by adjusting the oscillatory movement distance of the workpiece on the polishing pad and the configuration of the grooves on the polishing pad, the particular points on the workpiece may uniformly and alternately cross the groove and non-groove positions, so as to achieve a better uniformity for the surface of the polished workpiece. Optionally, the grooves of the polishing pad having above-mentioned configuration may only be disposed on a region corresponding to a part of a polishing track that the polished workpiece passes by, instead of being disposed on the whole surface of the polishing pad. For example, the disposed region is only in the middle part of the polishing track corresponding to the central portion of the workpiece, such as corresponding to within ±2R/3, ±R/2, ±R/3, ±R/4, ±R/5, ±R/10, or other certain range of the central portion of the workpiece, wherein R is radius of the workpiece.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A polishing method, comprising:

providing a polishing pad, wherein the polishing pad comprises a plurality of grooves, a width of each groove is W, and a pitch between two adjacent grooves is P;

setting an oscillatory movement distance of a workpiece on the polishing pad, wherein the oscillatory movement distance enables any particular point on the workpiece to cross the same number of grooves, when a direction between the particular point and the center of the workpiece is perpendicular to a tangential direction of the grooves; and performing a polishing process on the workpiece with the oscillatory movement distance.

2. The polishing method according to claim 1, wherein the oscillatory movement distance is $D \cong P \times N - W$, and N is a positive integer.

3. The polishing method according to claim 1, wherein the polishing pad is a circular polishing pad.

4. The polishing method according to claim 3, wherein the grooves are a plurality of concentric circular grooves.

5. The polishing method according to claim 4, wherein a direction of the oscillatory movement is a radial direction of the concentric circular grooves.

6. The polishing method according to claim 1, wherein the polishing pad is a strip polishing pad.

7. The polishing method according to claim 6, wherein the grooves are a plurality of linear grooves.

8. The polishing method according to claim 7, wherein a direction of the oscillatory movement is perpendicular to a longitudinal direction of the linear grooves.

9. A polishing method, comprising:

providing a polishing pad, wherein the polishing pad comprises a plurality of grooves, a width of each groove is W, and a pitch between two adjacent grooves is P;

setting an oscillatory movement distance of a workpiece on the polishing pad as $D \cong P \times N - W$, wherein N is a positive integer; and performing a polishing process on the workpiece with the oscillatory movement distance.

10. The polishing method according to claim 9, wherein the polishing pad is a circular polishing pad.

11. The polishing method according to claim 10, wherein the grooves are a plurality of concentric circular grooves.

12. The polishing method according to claim 11, wherein a direction of the oscillatory movement is a radial direction of the concentric circular grooves.

13. The polishing method according to claim 9, wherein the polishing pad is a strip polishing pad.

14. The polishing method according to claim 13, wherein the grooves are a plurality of linear grooves.

15. The polishing method according to claim 14, wherein a direction of the oscillatory movement is perpendicular to a longitudinal direction of the linear grooves.

16. A polishing pad, for performing a polishing process on a workpiece, wherein during the polishing process, the workpiece is set with an oscillatory movement distance D on the polishing pad, the polishing pad comprising:

a plurality of grooves, wherein a width W of each groove and a pitch P between two adjacent grooves satisfy $D \cong P \times N - W$, and N is a positive integer.

17. The polishing pad according to claim 16, wherein the oscillatory movement distance D is 25.4 mm.

18. The polishing pad according to claim 16, wherein the polishing pad is a circular polishing pad.

19. The polishing pad according to claim 18, wherein the grooves are a plurality of concentric circular grooves.

20. The polishing pad according to claim 19, wherein a direction of the oscillatory movement is a radial direction of the concentric circular grooves.

21. The polishing pad according to claim 16, wherein the polishing pad is a strip polishing pad.

22. The polishing pad according to claim 21, wherein the grooves are a plurality of linear grooves.

23. The polishing pad according to claim 22, wherein a direction of the oscillatory movement is perpendicular to a longitudinal direction of the linear grooves.

24. A polishing system, comprising:

a polishing pad, comprising a plurality of grooves, wherein a width of each groove is W, and a pitch between two adjacent grooves is P; and a workpiece, disposed on the polishing pad, and set with an oscillatory movement distance D on the polishing pad, wherein the oscillatory movement distance $D \cong P \times N - W$, and N is a positive integer.

25. The polishing system according to claim 24, further comprising a workpiece carrier, for fixing the workpiece on a surface of the polishing pad, and enabling the workpiece to shift and rotate on the polishing pad.

26. The polishing system according to claim 24, further comprising a polishing platen, for sustaining the polishing pad, and enabling the polishing pad to rotate or move.

27. The polishing system according to claim 24, wherein the oscillatory movement distance D is 25.4 mm.

28. The polishing system according to claim 24, wherein the polishing pad is a circular polishing pad.

29. The polishing system according to claim 28, wherein the grooves are a plurality of concentric circular grooves.

30. The polishing system according to claim 29, wherein a direction of the oscillatory movement is a radial direction of the concentric circular grooves.

31. The polishing system according to claim 24, wherein the polishing pad is a strip polishing pad.

32. The polishing system according to claim 31, wherein the grooves are a plurality of linear grooves.

33. The polishing system according to claim 32, wherein a direction of the oscillatory movement is perpendicular to a longitudinal direction of the linear grooves.

* * * * *